United States Patent [19]

Colclasure

[11] 4,359,061

[45] Nov. 16, 1982

[54] DEVICE FOR CLASPING HAIR

[76] Inventor: G. Craig Colclasure, 157 Peck Hill Rd., Woodbridge, Conn. 06525

[21] Appl. No.: 239,142

[22] Filed: Feb. 27, 1981

Related U.S. Application Data

[63] Continuation of Ser. No. 24,619, Mar. 28, 1979.

[51] Int. Cl.[3] ..... A45D 24/38

[52] U.S. Cl. ..... 132/144; 132/11 R

[58] Field of Search ..... 132/142–146, 132/11 R

[56] References Cited

U.S. PATENT DOCUMENTS

| | | | |
|---|---|---|---|
| 930,195 | 8/1909 | Kohn | 132/144 |
| 964,494 | 7/1910 | Cranmer | 132/144 X |
| 1,276,828 | 8/1918 | Tannler | 132/146 X |
| 2,955,604 | 10/1960 | Beal et al. | 132/144 X |

*Primary Examiner*—G. E. McNeill

*Attorney, Agent, or Firm*—Fitzpatrick, Cella, Harper & Scinto

[57] ABSTRACT

A device for clasping hair comprises a comb member that includes a base portion having a facing surface and a plurality of teeth extending in spaced, generally mutually parallel relation from the base portion. A clasp member having a clasp surface includes a loop for embracing at least one of the teeth of the comb member in sliding relation to thereby mount the clasp member on the comb member with the facing and clasping surfaces in tightly confronting relation. At least one of the facing and the clasping surfaces is contoured to diverge from the other of the surfaces and define a region having a generally V-shaped cross-section therebetween when in confronting relation.

7 Claims, 6 Drawing Figures

Fig. 1.
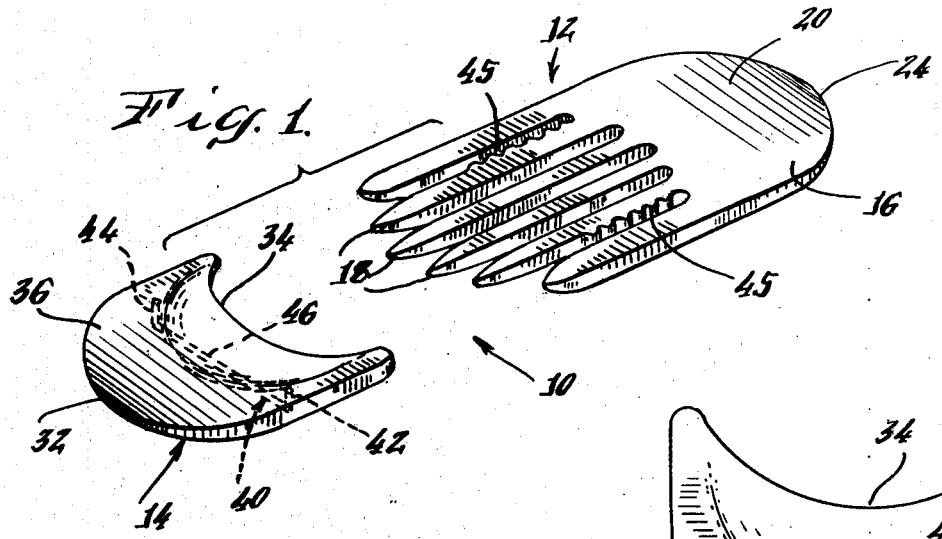
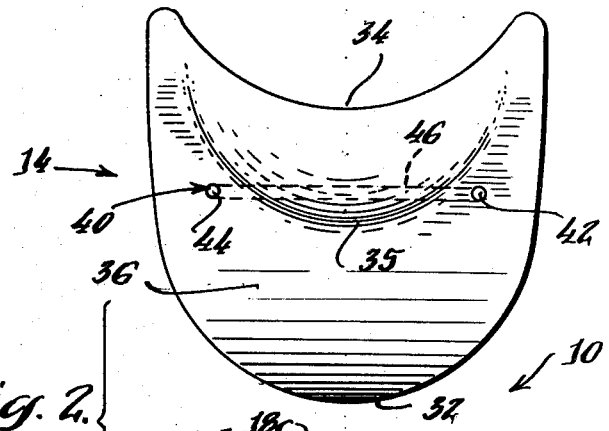
Fig. 2.
Fig. 3.
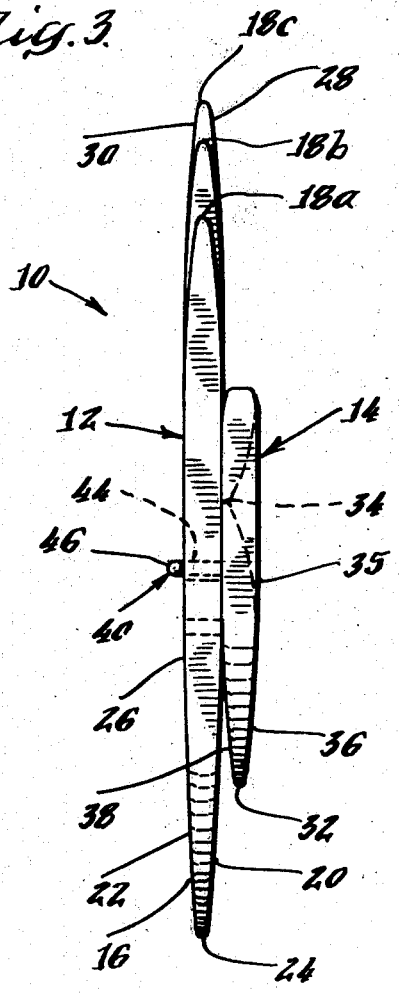
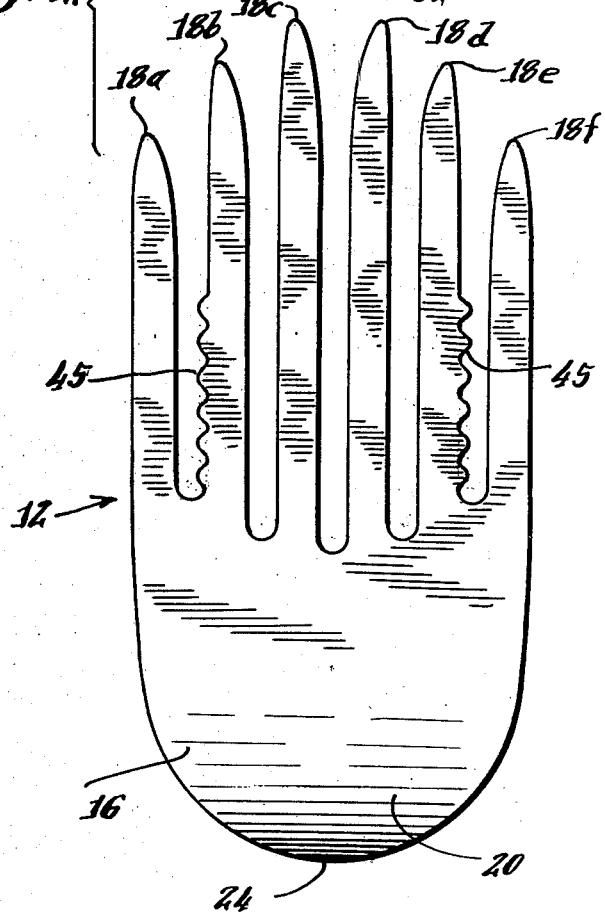

DEVICE FOR CLASPING HAIR

This is a continuation of application Ser. No. 24,619, filed Mar. 28, 1979.

BACKGROUND OF THE INVENTION

The present invention relates to a device for clasping hair and more particularly relates to a device that may be used to arrange and position long hair in various styles.

Various devices for clasping or otherwise arranging and positioning hair in desired styles have been proposed. Perhaps the simplest of these devices is known as a "bobby pin" and comprises an elongated, U-shaped clasp made of a resilient material. Hair is held between the legs of the U-shaped clasp. Another common device is called a "barrette" and includes a pair of elongated clasp members that are joined at one end by a hinge so that they may be closed together in a jaw-like manner to hold hair therebetween. Still another device includes a flexible pad, made for example, from leather, having two spaced holes therein. The pad is bent to an arcuate configuration so that a pin may be then be received through the holes. The pad and pin thereby define an enclosed area in which hair may be held.

The present invention relates to a device for clasping hair in a desired position and arranging it in a desired style. For example, this device of the present invention may be used to arrange hair in a simple pony tail or in a fan-like array.

Accordingly, it is an object of the present invention to provide a device for clasping hair that may be integrated with and assist in arranging hair in various desired styles.

It is a further object of the present invention to provide a device for clasping hair that is itself decorative and stylish. It is still another object of the invention to provide a device for clasping hair that is easily mountable therewith yet becomes firmly secured to the hair when so mounted. Despite being firmly secured to the styled hair, the device may, nevertheless, be easily removed therefrom.

In a preferred embodiment of the present invention, to be described below in detail, the device for clasping hair comprises a comb member that includes a base portion having a facing surface and a plurality of teeth extending in generally mutually parallel relation from the base portion. A clasp member having a clasping surface, comprises a comb engaging structure for embracing at least one of the teeth of the comb member in sliding relation to thereby mount the clasp member on the comb member with the facing and clasping surfaces in tightly confronting relation. At least one of the facing and clasping surfaces is contoured to diverge from the other of the surfaces and thereby define a region having a generally V-shaped cross-section when in confronting relation.

The device of the invention is used by arranging hair between the teeth of the comb member and against the facing surface of the base portion of the comb member. The clasp member is then mounted in sliding relation on the clasp member by sliding the comb engaging structure onto the teeth of the comb member with the hair tightly clasped between the confronting facing and clasping surfaces. Because the confronting surfaces define a region having a generally V-shaped cross-section, the clasp member may be easily mounted on the comb member. Furthermore, because of the structural relationship of the respective surfaces, hair is tightly held therebetween in the desired style, wedging the comb and clasp members apart within the limits imposed by the engagement structure.

The device of the present invention is also easy to apply to the hair. The comb member is merely placed in the hair as noted above, and the clasp member slid thereon. The respective members are also shaped to cause the clasped hair to assume certain patterns depending upon how the respective members are assembled.

Other objects, aspects and advantages of the present invention will be pointed out in or will be understood from the following detailed description provided below in conjunction with the accompanying drawings.

BRIEF DESCRIPTION OF THE DRAWINGS

FIG. 1 is a perspective view of an illustrative embodiment of the device of the present invention for clasping hair shown with the comb and clasp members separated. The clasp member is shown in one attitude with respect to the comb member.

FIG. 2 is a top plan view of this device again shown with the comb and the clasp members separated but with the clasp member in an attitude relative to the comb member opposite that shown in FIG. 1.

FIG. 3 is a side elevational view of the hair clasping device with the comb and clasp members assembled and in the attitude shown in FIG. 2.

DETAILED DESCRIPTION OF THE PREFERRED EMBODIMENT

As shown in FIGURES, the illustrative embodiment of the hair clasping device of the present invention, generally indicated at 10, includes a comb member generally indicated at 12, and a clasp member generally indicated at 14. Each of the members is preferrably made from a material that has a suitably pleasant appearance. For example, it may be made from highly finished wood such as teak or mahogany or alternatively may be made from a molded and polished plastic.

Figure 5:
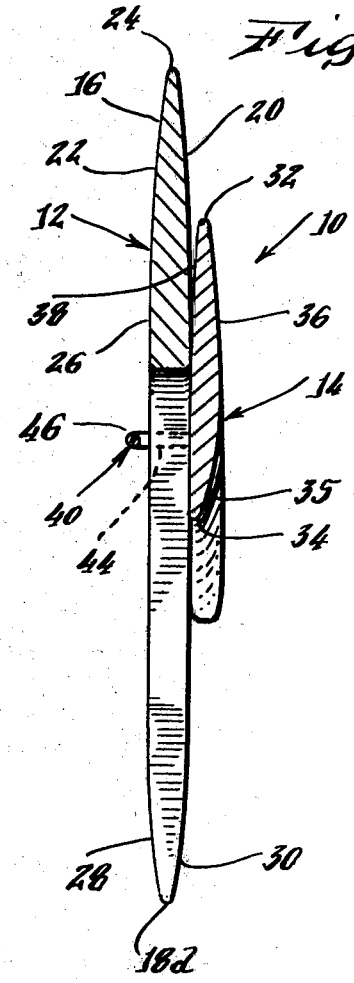
FIG. 5 is a vertical cross-sectional view taken through plane 5—5 in FIG. 4.
Figure 6:
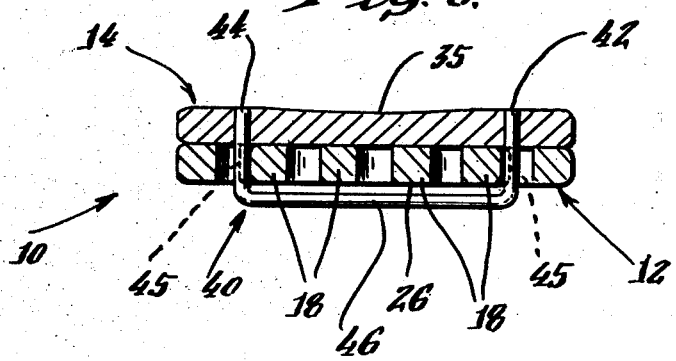
FIG. 6 is a vertical cross-sectional view taken through plane 6—6 in FIG. 4.

The comb member 12 is a relatively thin plastic-like structure that includes a base portion 16 and a plurality of teeth 18 that are integrally formed with and extend in mutually parallel relation from the base portion 16. As can be seen in FIGS. 3 and 5, the base portion has two opposing contoured facing surfaces 20 and 22 that converge toward an extreme convexly curved edge 24 from a relatively thick region 26 at the base of teeth 18. Moreover, each of the teeth 18 also has opposing converging contoured surfaces 28 and 30. The contoured surfaces of both the base portion and the teeth of the comb member are smoothly finished so that hair may be easily engaged thereon without snagging. Either of the converging facing surfaces 20 and 22 of the base portion 16 of the comb member may constitute a facing surface against which hair may be clasped by the clasped member in a manner described in greater detail below also.

The clasp member 14 comprises a generally plate-like structure having a first convexly curved edge 32 and a second concavely curved edge 34 that is generally congruent to the convexly curved edge 32. The convexly curved edge 32 of the clasp member is also generally congruent to the convexly curved edge 24 of the comb member. As can be seen in FIGS. 3 and 5, the clasp member also has opposing contoured clasping surfaces 36 and 38 that converge respectively toward both the convexly and concavely curved edges from a relatively thick intermediate region 35. Each clasping surface 36 and 38 may cooperate with one facing surface of the comb member in a manner to be described below to clasp hair therebetween.

Figure 4:
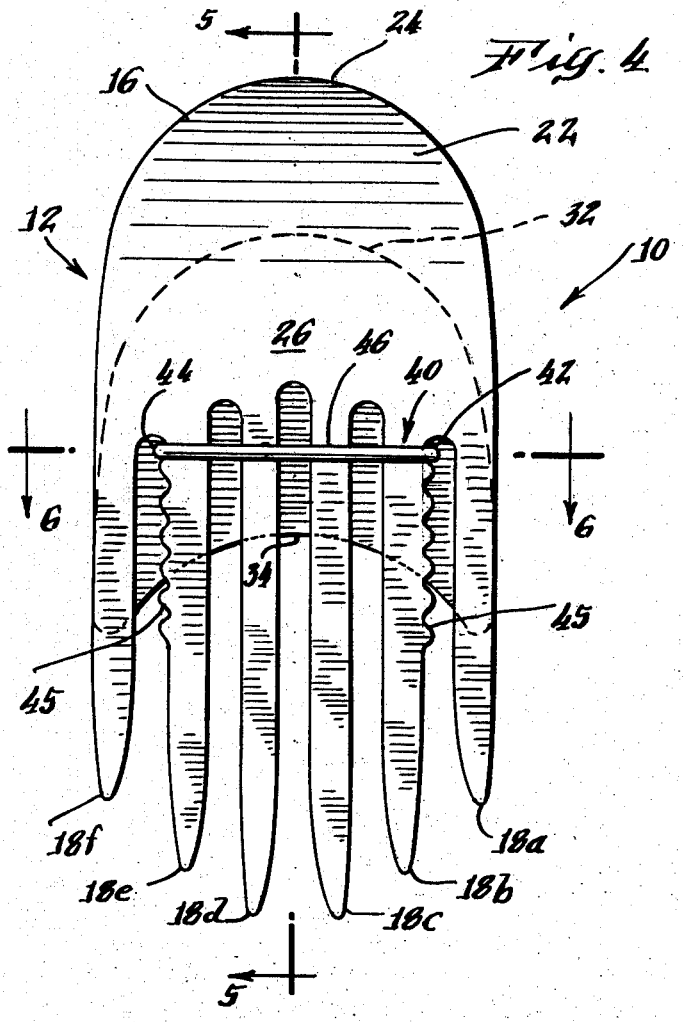
FIG. 4 is a bottom plan view of the device with the comb and clasp members assembled and in the attitude shown in FIG. 2.

The clasp member includes an engagement structure for mounting it on the comb member with the respective facing surface of the comb member and clasping surface of the clasp member in tightly confronting relation as can be seen in FIGS. 3 and 5. In the preferred embodiment, this arrangement comprises a generally U-shaped loop 40 having opposing legs 42 and 44 which are secured by suitable means to the clasp member 14. The loop further comprises a span 46 that interconnects the legs 42 and 44. As can be seen in FIGS. 2 and 4, the loop is adapted to embrace the four innermost teeth **18*b* through 18*e* of the comb member, legs of the loop being spaced by a distance slightly larger than the distance between outer edges of teeth 18*b* and 18*e***. Accordingly, the clasp member may be mounted on the comb member by sliding the loop onto these teeth.

If desired, the outer edges of teeth **18*b* and 18*e*, that is those teeth embraced by the legs 42 and 44 of the loop 40, may be provided with a series of nubs 45, shown in FIG. 2**, for further holding and securing the clasp member in tight mounted position on the comb member.

As can be seen in FIG. 5, each leg 42 and 44 of the loop 40 has a length only slightly greater than the thickness of the comb member. Accordingly, when the clasp member is mounted on the comb member, the loop holds the facing and clasping surfaces in tightly confronting relation, as shown in FIGS. 3 and 5. As can be seen, then, the confronting clasping and facing surfaces of the clasp member and comb member respectively define a region 48 having a generally V-shaped cross-section.

The hair clasping device of the present invention is used by positioning hair between the teeth 18 of the comb member 12 and against one facing surface 20 and 22 of the base portion 16 thereof. The clasp member 14 is then mounted on the comb member by sliding the loop 40 into embracing engagement with teeth **18*b* through 18*e*. It will be readily appreciated that hair so positioned will then be clasped between the confronting facing and clasping surfaces in the region 48**. Moreover, the thickness of the hair tends to force or wedge the clasp member and comb member apart. However, since the distance between the respective members is limited by the structure of the loop, the hair is tightly locked therebetween. Therefore, the device of the present invention is firmly fixed in position on the hair so clasped in the chosen style.

Different hair styles may be achieved with the device of the invention. For example, the clasp member may be positioned on the comb member with the convexly curved edges 32 and 24 respectively aligned, as shown in FIGS. 2 through 5. In this manner, hair locked between the respective members may be made to spread outwardly in a fan-like pattern or array for certain styles.

Alternatively, as illustrated in FIG. 1, the clasp member may be mounted on the comb member with its concavely curved edge 34 adjacent the base portion 16 of the comb member. Again, the diverging facing and clasping surfaces of the base member of the comb member and of the clasp member tend to lock hair therebetween. However, hair mounted in the device of the invention in such a manner tends to lie together such as in a pony tail because the concavely curved edge 34 of the clasp member gathers it together.

The clasp member may also be removed easily from the comb member to release hair clasped therebetween. The confronting facing and clasping surfaces of the comb and clasp member respectively do not prevent such disengagement.

Thus the device of the present invention is simple yet effective to clasp hair in various styles. The device is also decorative itself in its simplicity.

Accordingly, although a specific embodiment of the present invention has been described in detail, it is to be understood that this is for purposes of illustration. Modifications may be made to the device of the invention for clasping hair in order to adapt it to particular applications.

What is claimed is:

1. A device for clasping hair comprising:

a comb member including a base portion having length, width and thickness, said length and width of said base portion being greater than said thickness thereof and defining a facing surface of substantial area, said comb member further including a plurality of generally mutually parallel teeth extending from said base portion in the direction of one of the major dimensions with surfaces of said teeth in continuous, generally coplanar relation to said facing surface; and a clasp member including a clasp portion having length, width and thickness, said length and width of said clasp portion being greater than said thickness thereof and defining a clasping surface of substantial area, said clasp member further including means for slidably receiving and embracing at least one of said teeth by movement of said clasp member relatively to said comb member in the direction of said one major dimension, at least a substantial part of said clasp portion lying to one side of said embracing means in the direction of said one major dimension whereby, with said tooth slidably received by said embracing means, said clasping surface is positioned in confronting relation to said facing surface; said embracing means further limiting the space between said surfaces when said tooth is slidably received thereby and accordingly more tightly embracing said tooth when said surfaces are urged apart, at least one of said facing surface and said clasping surface being contoured to diverge from the other of said surfaces, with said divergence increasing in the direction of said one major dimension from the location of said embracing means to a location remote from said embracing means, to thereby define a region between said surfaces having a generally V-shaped cross-section, whereby a material such as hair may be positioned between said teeth and laid adjacent said facing surface of said comb member and thereafter said clasp member may be mounted on said comb member by slidably receiving said tooth in said embracing means until said clasping surface and said facing surface are in said confronting relation with said material confined therebetween in said region and further until said surfaces are urged apart by said material to cause the embrace of said tooth by said embracing means to tighten.

2. The device as claimed in claim 1, further comprising lock means for preventing inadvertent demounting of said clasp member from said comb member after a material such as hair has been confined in said region.

3. A device as claimed in claim 1, said embracing means comprising a generally U-shaped loop having legs and a span, said legs being spaced by a distance slightly larger than said teeth embraced thereby.

4. A device as claimed in claim 1, said base portion of said comb member having a convexly curved edge, said clasp member also having a convexly curved edge, generally congruent to said convexly curved edge of said comb member whereby hair secured between said confronting surfaces is disposed in a fan-like array.

5. A device as claimed in claim 1, said base portion of said comb member having a convexly curved edge and said clasp member having a concavely curved edge bordering said clasping surface.

6. A device as claimed in claim 2, wherein said lock means comprises detent means formed on said teeth embraced by said embracing means when said clasp member is mounted on said comb member.

7. A device as claimed in claim 3, comprising nub means formed on said teeth embraced by said legs of loop for engaging and retaining said legs.

* * * * *

UNITED STATES PATENT AND TRADEMARK OFFICE

CERTIFICATE OF CORRECTION

PATENT NO. : 4,359,061

DATED : November 16, 1982

INVENTOR(S) : G. Craig Colclasure

It is certified that error appears in the above-identified patent and that said Letters Patent is hereby corrected as shown below:

Column 2

Line 50, change "plastic" to --plate--.

Column 4 (CLAIM 1) :

Line 44, change "relatively" to --relative--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*